US010056222B2

(12) United States Patent
Bachmann et al.

(10) Patent No.: US 10,056,222 B2
(45) Date of Patent: Aug. 21, 2018

(54) ROTATING ANODE AND METHOD FOR PRODUCING A ROTATING ANODE

(71) Applicant: KONINKLIJKE PHILIPS N.V., Eindhoven (NL)

(72) Inventors: Peter Klaus Bachmann, Berlin-Kaulsdorf (DE); Hans Joachim Meys, Alsdorf (DE); Gereon Vogtmeier, Aachen (DE); Christoph Tobias Wirth, Vellmar (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 12 days.

(21) Appl. No.: 15/327,270

(22) PCT Filed: Jun. 26, 2015

(86) PCT No.: PCT/EP2015/064523
§ 371 (c)(1),
(2) Date: Jan. 18, 2017

(87) PCT Pub. No.: WO2016/023669
PCT Pub. Date: Feb. 18, 2016

(65) Prior Publication Data

US 2017/0169985 A1 Jun. 15, 2017

(30) Foreign Application Priority Data

Aug. 12, 2014 (EP) ..... 14180664

(51) Int. Cl.
*H01J 35/00* (2006.01)
*H01J 35/10* (2006.01)

(52) U.S. Cl.
CPC ..... *H01J 35/105* (2013.01); *H01J 2235/081* (2013.01); *H01J 2235/1204* (2013.01); *H01J 2235/1291* (2013.01)

(58) Field of Classification Search
None
See application file for complete search history.

(56) References Cited

U.S. PATENT DOCUMENTS 4,344,012 A 8/1982 Hubner
4,847,883 A 7/1989 Fourre
(Continued)

FOREIGN PATENT DOCUMENTS

DE 102006038417 A1 2/2008
EP 0016485 A1 10/1980
(Continued)

*Primary Examiner* — Hoon Song
(74) *Attorney, Agent, or Firm* — Larry Liberchuk

(57) ABSTRACT

The present invention relates to a rotating anode (100) comprising: an outer ring compound (6) comprising a first carbon material with a first material property and carbon fibers substantially aligned to a contour of the outer ring compound (6), wherein the outer ring compound (6) is configured to mechanically stabilize the rotating anode (100); an intermediate ring compound (5) comprising a second carbon material with a second material property differing from the first material property; a inner disc compound (2) comprising a layered fiber structure and a third carbon material with a third material property differing from the first and the second material property, wherein the inner disc compound (2) and the intermediate ring compound (5) are configured to provide a thermally conductive interface between the intermediate ring compound (5) and the inner disc compound (2); and an interface compound (3) comprising a metallic or a semi-metallic material, wherein the interface compound is coupled to the intermediate ring compound (5) and the inner disc compound (2).

15 Claims, 3 Drawing Sheets

(56) References Cited

U.S. PATENT DOCUMENTS

| | | | | |
|---|---|---|---|---|
| 8,363,787 | B2 | 1/2013 | Lathrop | |
| 2002/0154741 | A1* | 10/2002 | Rigali et al. | 378/144 |
| 2007/0071174 | A1 | 3/2007 | Hebert | |
| 2008/0043921 | A1* | 2/2008 | Freudenberger et al. | 378/144 |
| 2011/0129068 | A1 | 6/2011 | Lewalter | |
| 2012/0099703 | A1* | 4/2012 | Kraft et al. | 378/62 |

FOREIGN PATENT DOCUMENTS

| | | | |
|---|---|---|---|
| EP | 2188827 | B1 | 4/2012 |
| JP | 64003947 | A | 1/1989 |
| WO | 2009022292 | A2 | 2/2009 |
| WO | 2011001325 | A1 | 1/2011 |
| WO | 2011001343 | A1 | 1/2011 |

* cited by examiner

ROTATING ANODE AND METHOD FOR PRODUCING A ROTATING ANODE

CROSS-REFERENCE TO PRIOR APPLICATIONS

This application is the U.S. National Phase application under 35 U.S.C. § 371 of International Application No. PCT/EP2015/064523, filed on Jun. 26, 2015, which claims the benefit of European Patent Application No. 14180664.6, filed on Aug. 12, 2014. These applications are hereby incorporated by reference herein.

FIELD OF THE INVENTION

The present invention relates to the field of segmented hybrid carbon rotating anodes for X-ray tubes. Particularly, the present invention relates to a rotating anode and a method for producing a rotating anode.

BACKGROUND OF THE INVENTION

Anode rotational frequency and tolerable, non-destructive electron beam peak power levels of rotating anodes in X-ray tubes are limited by the material characteristics of the metal—usually molybdenum—used for the anode disk.

EP 2 188 827 B1 describes a hybrid design of an anode disk structure for high power X-ray tube configurations of the rotary-anode type.

The therein described X-ray tube configuration is equipped with anodes. The described design principle thereby provides means to overcome thermal limitation of peak power by allowing extremely fast rotation of the anode. An X-ray system equipped with a high peak power anode is also described. Such a high-speed rotary anode disk can be applied in X-ray tubes for material inspection or medical radiography, for X-ray imaging applications which are needed for acquiring image data of moving objects in real-time, such as e.g. in the scope of cardiac CT, or for any other X-ray imaging application. The described system is directed to a rotary anode disk divided into distinct anode segments with adjacent anode segments.

SUMMARY OF THE INVENTION

There may be a need to improve rotation anodes for X-ray tubes. These needs are met by the subject-matter of the independent claims of the present invention. Further exemplary embodiments of the present invention are evident from the dependent claims and the following description.

An aspect of the present invention relates to a rotating anode comprising: an outer ring compound comprising a first carbon material with a first material property and carbon fibres substantially aligned to a contour of the outer ring compound, wherein the outer ring compound is configured to mechanically stabilize the rotating anode; an intermediate ring compound comprising a second carbon material with a second material property differing from the first material property; an inner disc compound comprising a layered fibre structure and a third carbon material with a third material property differing from the first and the second material property, wherein the inner disc compound and the intermediate ring compound are configured to provide a thermally conductive interface between the intermediate ring compound and the inner disc compound; and an interface compound comprising a metallic or a semi-metallic material, wherein the interface compound is coupled to the intermediate ring compound and the inner disc compound.

In other words, the outer ring compound is configured to couple the intermediate ring compound with the inner disc compound, and to mechanically stabilize the whole assembly.

The term "mechanically stabilize" as used by the present invention may refer to any mechanically coupling or joining or affixing of two or more objects together resulting in a reinforcing or strengthening of the structure.

The term "substantially aligned to a contour of the outer ring compound" as used by the present invention, may define a direction in parallel to the contour of the outer ring compound or a tangential direction with respect to the contour of the outer ring compound with a deviation of less than 20°, or less than 10° or less than 2°.

The present invention advantageously provides a compromise between mechanical stability, weight and thermal conductivity of the carbon materials used.

The present invention advantageously uses graphite or fibre-reinforced carbon composite materials, or any kind of carbon composite materials to overcome the limitations of massive, comparably heavy, expensive metal anodes.

The present invention advantageously improves mechanical and thermal properties imposing an upper limit to the maximum rotation frequency and to the maximum current density of the X-ray-generating electron beam impinging the focal track located on top of the anode. To increase the rotational frequency, the electron-beam, abbreviated e-beam, power level and density, the thermal loadability and, thus, the peak X-ray emission level, an improved cooling is mainly addressed.

The present invention advantageously provides a segmented carbon rotating anode for X-ray tubes.

A further, second aspect of the present invention relates to an X-ray tube comprising a high voltage generator, a cathode, and a rotating anode according to the first aspect of the present invention or according to any implementation form of the first aspect of the present invention.

A further, third aspect of the present invention relates to a method for producing a rotating anode, the method comprising the steps of: Providing an outer ring compound comprising a first carbon material with a first material property and carbon fibres substantially aligned to a contour of the outer ring compound, wherein the outer ring compound is configured to mechanically stabilize the rotating anode; Providing an intermediate ring compound comprising a second carbon material with a second material property differing from the first material property and providing the inner disc compound comprising a layered fibre structure and a inner disc compound comprising a layered fibre structure and a third carbon material with a third material property differing from the first and the second material property, wherein the inner disc compound and the intermediate ring compound are configured to provide a thermally conductive interface between the intermediate ring compound and the inner disc compound; and providing an interface compound comprising a metallic or a semi-metallic material, wherein the interface compound is coupled to the intermediate ring compound and to the inner disc compound.

According to an exemplary embodiment of the present invention, the intermediate ring compound comprises as the second carbon material graphitic carbon.

This advantageously allows a precise adjustment of the outer ring compound and the inner disc compound according to their respective needs and considered tasks.

According to an exemplary embodiment of the present invention, the outer ring compound and/or the inner disc compound and/or intermediate ring compound substantially comprise a rotational symmetry.

This advantageously provides that the rotating anode can be easily implemented in a rotating anode setup and the rotating anode does not comprise an unbalance when rotated around a rotation axis. The term "substantially comprise a rotational symmetry" as used by the present invention may define, that an object is substantially the same after a certain amount of rotation, ignoring length deviations within normal production or manufacturing precisions, e.g. +/−5%. An object may have more than one rotational symmetry; for instance, if reflections or turning it over are not counted. The degree of rotational symmetry is how many degrees the shape has to be turned to look the same on a different side or vertex.

According to an exemplary embodiment of the present invention, the interface compound comprises as the metallic or semi-metallic material from the group comprising Titanium, Vanadium, Chromium, Manganese, Iron, Cobalt, Nickel, Copper, Zinc, Aluminium, Silicon, Zirconium, Niobium, Molybdenum, Palladium, Silver, Indium, Tin, Platinum or Gold. The concentration of any of these above listened elements may be higher than 0.5%, wherein % is given in weight.

This advantageously allows providing composite materials resisting very high temperatures, e.g. temperatures above 1000° C. during tube bake out and/or during tube operation.

According to an exemplary embodiment of the present invention, the interface compound comprises as the metallic or semi-metallic material a mixture or an alloy from the group comprising Titanium, Vanadium, Chromium, Manganese, Iron, Cobalt, Nickel, Copper, Zinc, Aluminium, Silicon, Zirconium, Niobium, Molybdenum, Palladium, Silver, Indium, Tin, Platinum or Gold. The concentration of any of these above listened elements may be higher than 0.5%, wherein % is given in weight.

According to an exemplary embodiment of the present invention, the interface compound comprises a melting or liquidus temperature above 1000° C. This advantageously allows improving the thermal robustness of the rotating anode.

According to an exemplary embodiment of the present invention, the outer ring compound is configured to limit thermal expansions of the rotating anode or to limit centrifugal forces or to limit other mechanical forces. This advantageously allows improving the thermal robustness of the rotating anode.

According to an exemplary embodiment of the present invention, the intermediate ring compound comprises a metallic coating on a lateral side of the intermediate ring compound. This provides an improved way of coupling and connecting the inner disc compound and the intermediate ring compound of the rotating anode.

According to an exemplary embodiment of the present invention, the intermediate ring compound is configured to transport heat from the intermediate ring compound to a surface of the rotating anode. This advantageously allows improving the thermal robustness of the rotating anode, since the cooling by heat dissipation is improved due to improved heat transport to the surface parts of the rotating anode.

According to an exemplary embodiment of the present invention, the inner disc compound comprises as the layered fibre structure a textile layer structure with a first preferred direction of fibre orientation and a second preferred direction of fibre orientation. This advantageously allows improving the mechanical stability and the thermal conductivity of the rotating anode.

According to an exemplary embodiment of the present invention, a first type of fibres is aligned along the first preferred direction and a second type of fibres is aligned along the second preferred direction.

According to an exemplary embodiment of the present invention, the fibres of the first type are configured to mechanically stabilize the inner disc compound and the fibres of the second type are configured to provide thermal conductivity.

According to an exemplary embodiment of the present invention, the outer ring compound is configured to limit thermal expansion of the inner disc compound and the intermediate compound.

BRIEF DESCRIPTION OF THE DRAWINGS

A more complete appreciation of the invention and the attendant advantages thereof will be more clearly understood by reference to the following schematic drawings, which are not to scale, wherein.

DETAILED DESCRIPTION OF EMBODIMENTS

Figure 1:
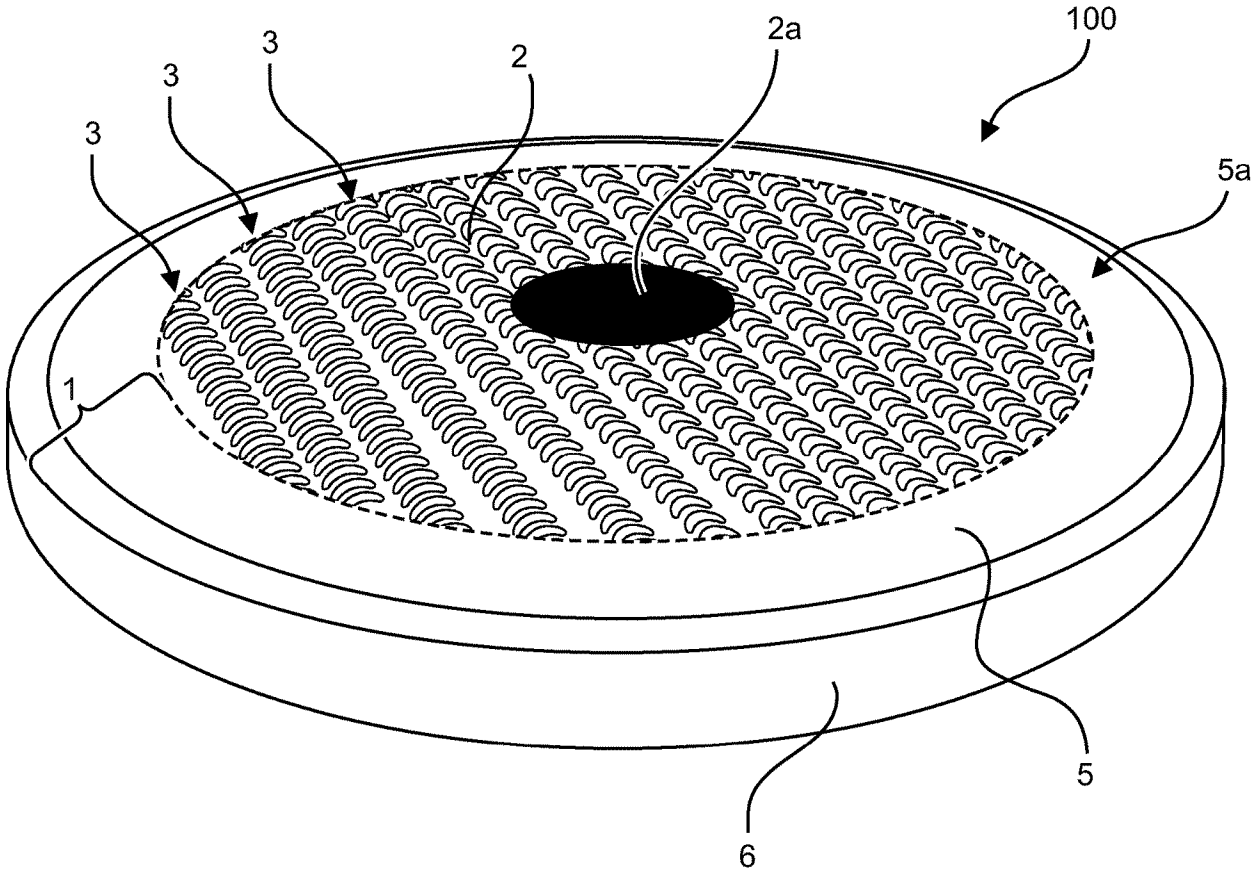
FIG. 1 shows a schematic diagram of a rotating anode according to an exemplary embodiment of the present invention.

The illustration in the drawings is purely schematic and does not intend to provide scaling relations or size information. In different drawings or Figs, similar or identical elements are provided with the same reference numerals. Generally, identical parts, units, entities or steps are provided with the same reference symbols in the description.

FIG. 1 shows a schematic diagram of a rotating anode according to an exemplary embodiment of the invention.

FIG. 1 shows a segmented carbon rotating anode. According to an exemplary embodiment of the present invention, a rotating anode is made from at least two different forms of carbon materials, which comprise different mechanical properties, for instance, tensile strength, bending strength, specific weight and/or different thermal properties, for instance thermal conductivity, thermal diffusivity, thermal expansion coefficients.

According to an exemplary embodiment of the present invention, the at least two different ring compounds, for instance the outer ring compound and the inner disc compound, comprise substantially a rotational symmetric shape, for instance they comprise the shape of rings or disks. Substantially rotationally symmetric as used by the present invention means for instance that the outer ring compound and/or the inner disc compound and/or the interface compound comprise a rotating unbalance as an uneven distribution of mass around an axis of rotation of less than a mass eccentricity of less than 8 mm.

The substantially rotationally symmetry advantageously allows that the mass of the rotating anode is evenly distributed about an axis of rotation. This advantageously allows that moments are prevented which give the rotating anode a wobbling movement characteristic or any other kind of vibration of rotating structures.

According to an exemplary embodiment of the present invention, a rotating anode 100 may comprise an outer ring compound 6, an intermediate ring compound 5, an inner disc compound 2, and an interface compound 3.

An outer ring compound 1 may be formed by the outer ring compound 6 and an intermediate ring compound 5.

The outer ring compound 6 may comprise a first carbon material with a first material property and carbon fibres substantially aligned to a contour of the outer ring compound 6, wherein the outer ring compound 6 may be configured to mechanically stabilize the rotating anode 100, or in other words, to mechanically stabilize the intermediate ring compound 5, the inner disc compound 2, and the interface compound 3.

The intermediate ring compound 5 may comprise a second carbon material with a second material property differing from the first material property, wherein the intermediate ring compound 5 is configured to provide a thermally conductive interface between the outer ring compound 6 and a inner disc compound 2.

The inner disc compound 2 may comprise a layered fibre structure and a third carbon material with a third material property differing from the first and the second material property. The outer ring compound 6, the intermediate ring compound 5, and the inner disc compound 2 may comprise carbon materials, graphitic carbon materials or carbon composite materials.

The carbon composite materials may also be named carbon fiber-reinforced carbon (abbreviated C/C or CFRC) or reinforced carbon-carbon (RCC) or carbon fiber carbon matrix composite (CFC). The graphitic carbon materials may also be named graphite. Carbon fibre-reinforced carbon (in the following the abbreviation C/C is used) is a composite material comprising carbon fibre reinforcement in a matrix of graphitic carbon or graphite. The graphitic carbon and carbon composite materials may comprise amorphous carbon.

The carbon materials of the outer ring compound 6, the intermediate ring compound 5, and the inner disc compound 2 may be all differing carbon materials or may be at least partially, for instance, two out of three, differing materials or maybe the same carbon materials.

According to an exemplary embodiment of the present invention, the inner disc compound may comprise as the layered fiber structure a textile layer structure with a first preferred direction of fiber orientation and a second preferred direction of fiber orientation.

A first type of fibers may be aligned along the first preferred direction and a second type of fibers may be aligned along the second preferred direction, wherein the fibers of the first type are configured to mechanically stabilize the inner disc compound 2 and the fibers of the second type are configured to provide thermal conductivity.

The first direction may be substantially radial or tangential with respect to an outer contour of the rotating anode. A filling material may be used, for instance a C/C material. The properties of the C/C material can be tuned by selecting various types of fiber, adjusting fiber volume content, defining fiber orientation, assembly of various layers, and selection of infiltrating filler material. This advantageously provides a rotating anode with advantages like a high specific heat capacity, excellent high-temperature friction, and excellent wear characteristics. The fibers may be woven or laid.

The outer ring compound 1 may comprise a C/C material.

An interface compound 3 may comprise a metallic or semi-metallic material and the interface compound may be configured to connect the outer ring compound and the inner disc compound. The interface compound 3 may form a metallic interface between the at least two different forms of carbon—the outer ring compound 1 and the inner disc compound 2—forming the rotating anode of the X-ray tube and the interface compound 3 may have a melting or liquidus temperature of 1000° C. or higher.

The interface compound 3 may comprise the metallic or semi-metallic material like, for instance, Titanium, Vanadium, Chromium, Manganese, Iron, Cobalt, Nickel, Copper, Zinc, Aluminium, Silicon, Zirconium, Niobium, Molybdenum, Palladium, Silver, Indium, Tin, Platinum or Gold or any mixture or any alloy of these materials.

The carbon fibre-reinforced carbon (C/C) outer ring or the outer ring compound 1 may be used for an increased mechanical stability of the rotating anode.

The intermediate ring compound 5 of the outer ring compound 1 may provide a higher—compared to the other carbon materials—thermal conductivity. The intermediate ring compound 5 may be configured to accept a coating on top, wherein the coating is suitable as X-ray generating focal track for the impinging electron beam inside an X-ray tube.

The inner disc compound 2 may be fabricated from carbon fibre-reinforced carbon disk materials. The inner disc compound may comprise a central hole or any other central recess, which is configured to connect the rotating anode to a drive motor.

The interface compound 3 may be fabricated as a ring-shaped metallic interface composed of for instance, 15% nickel, 5% chromium, 80% iron, forming an alloy or metallic compound with a liquidus temperature of more than 1300° C.

As the metallic coating on a top side 5*a* of the intermediate ring compound 5 for instance wolfram or rhenium may be used as materials tracking the impinging electron beam.

Figure 2:
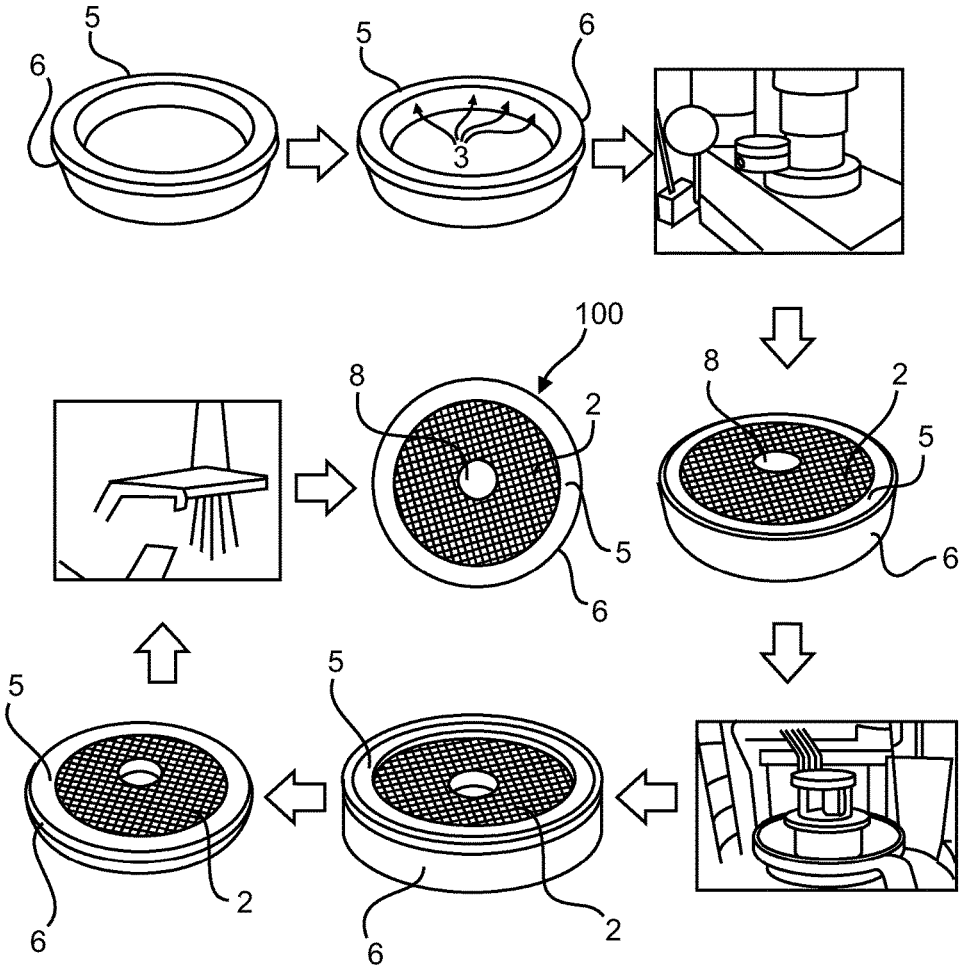
FIG. 2 shows a schematic flow-chart diagram of a method for producing a rotating anode according to an exemplary embodiment of the present invention.

FIG. 2 shows an exemplary flow-chart diagram of a method for producing a rotating anode.

In step 1 of the method for producing a rotating anode, the outer C/C ring and the graphite ring are mechanically pressed into each other.

In step 2, a metallic composite of approximately 15% nickel, approximately 5% chromium, approximately 80% Iron is put onto the innermost surface of the graphite ring. Approximately as used by the present invention may refer to a relative deviation of less than 10%.

In step 3, a centrally positioned layered C/C disk is pressed with a well-defined mechanical force into the outer structure or outer ring compound 1, in this step a forming press, commonly shortened to press, may be used which is a machine tool that changes the shape of a work piece by the application of pressure, as shown in the Fig.

In step 4, the rotating anode as assembled and previous to any heating treatment is shown.

In step 5, the rotating anode is heated to, for instance, more than 1300° C. to facilitate the joining. The heating may be performed in a vacuum oven or in oven purged by a chemical inert or inactive, protective gas atmosphere, e.g. a gas atmosphere which does not undergo chemical reactions with the rotating anode under a set of given conditions, in step 5 a oven may be used to provide the heating, as shown in the Fig.

In step 6, after cooling down to room temperature, the multi-carbon-material-based anode may be dismounted. The individual carbon-compounds of different heights that make up the anode may be machined and shaped to arrive at a uniform smooth surface with a desired shape. Height differences may be in the range of 1 mm to 7 mm, or 0.5 mm to 4 mm, for instance.

In step 7, the multi-carbon composite anode may be transferred to a suitable unit that allows depositing a metallic focal track onto at least the graphite ring of the multi-carbon composite anode.

In step 8, chemical vapour deposition or physical vapour deposition processes, for instance plasma spray methodologies or plasma CVD methods are used to deposit a metallic focal track at elevated or non elevated temperatures onto the multi-carbon composite anode to arrive at a rotating anode.

Figure 3:
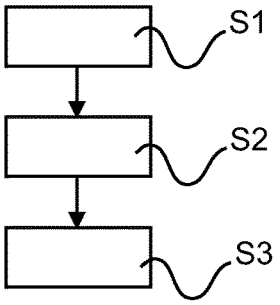
FIG. 3 shows a schematic flow-chart diagram of a method for producing a rotating anode according to a further exemplary embodiment of the present invention.

A post-processing may comprise further steps like grinding, polishing or cleaning which may be performed to generate a surface finishing of the rotating anode. FIG. 3 shows an exemplary flow-chart diagram of a method for producing a rotating anode according to a further embodiment of the present invention.

The method for producing a rotating anode may comprise the following steps:

As a first step of the method, providing S1 an outer ring compound 6 comprising a first carbon material with a first material property and carbon fibres substantially aligned to a contour of the outer ring compound 6 may be performed, wherein the outer ring compound 6 is configured to mechanically stabilize the rotating anode 100.

As a second step of the method, providing S2 an intermediate ring compound 5 may be performed, the intermediate ring compound 5 comprising a second carbon material with a second material property differing from the first material property and providing the inner disc compound 2 comprising a layered fibre structure and a third carbon material with a third material property differing from the first and the second material property, wherein the inner disc compound 2 and the intermediate ring compound 5 are configured to provide a thermally conductive interface between the intermediate ring compound 5 and the inner disc compound 2.

As a third step of the method, providing S3 an interface compound 3 comprising a metallic or a semi-metallic material may be performed, wherein the interface compound is coupled to the intermediate ring compound 5 and the inner disc compound 2.

The interface compound 3 may comprise a metallic or semi-metallic material, wherein the interface compound 3 is coupled to the outer ring compound 1 and the inner disc compound 2.

Further, an assembling of the rotating anode may be conducted, wherein the rotating anode is assembled.

Figure 4:
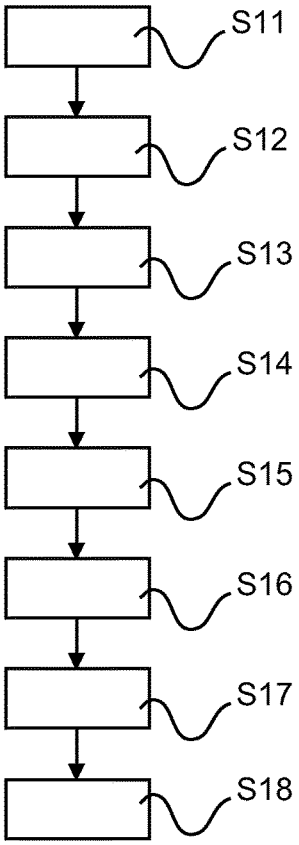
FIG. 4 shows a schematic flow-chart diagram of a method for producing a rotating anode according to an exemplary embodiment of the present invention.

FIG. 4 shows a flow-chart diagram of a method for producing a rotating anode. The method may comprise the following steps:

In step S11 heating the outer C/C ring and the graphite ring and mechanically pressing the C/C ring and the graphite ring into each other may be performed.

In step S12, putting a metallic layer composed of nickel, chromium, iron or other metals onto the innermost surface of the graphite ring may be conducted.

In step S13, a centrally positioned layer C/C disk may be pressed with a well-defined mechanical force into the outer structure composed of outer C/C ring, graphite ring and metallic layer.

In step S14, the rotating anode may be assembled and prepared for a subsequent heating process. For instance, the rotating anode may be clean by solvents or purged with nitrogen gas.

In step S15, the anode may be heated up to 1300° C. to facilitate joining. The heating process may be performed in a vacuum oven.

In step S16, After cooling down to room temperature, the multi C-based anode may be dismounted. The individual C-components of different heights that make up the anode are machined and shaped to arrive at a uniform smooth surface with a desired shape (e.g. flat or curved).

In step S17, the multi C-anode may be transferred to a suitable unit that allows depositing a metallic focal track, forming the metallic coating on a top side 5*a*, onto at least the graphite ring of the multi-C-anode.

In step S18, a CVD or PVD processes may be performed, e.g. plasma spray methodologies or plasma CVD methods may be used to deposit the metallic focal track, forming the metallic coating on a top side 5*a*, at elevated temperatures onto the multi-C-anode to arrive at the product shown in the center of this picture. Additional steps like grinding, polishing etc. are sometimes performed to generate a surface finish of the e-beam focal track suitable for X-ray generation.

Figure 5:
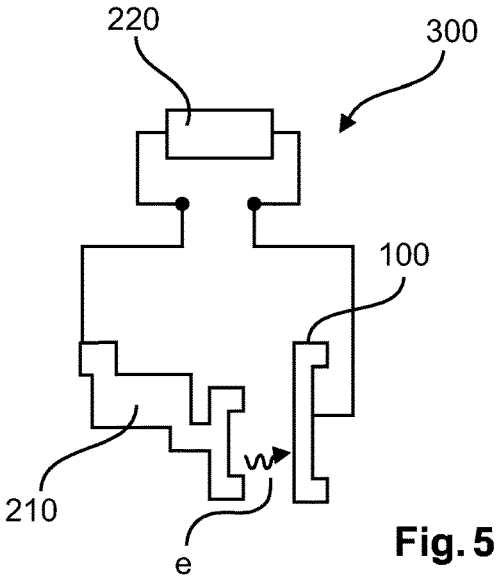
FIG. 5 shows a schematic diagram of an X-ray tube according to an exemplary embodiment of the present invention.

FIG. 5 shows a schematic diagram of an X-ray tube according to a further embodiment of the present invention.

The X-ray tube 300 may comprise a high voltage generator 220, a cathode 210 and a rotating anode 100.

The rotating anode 100 may be rotated by electromagnetic induction from a series of stator windings outside the X-ray tube 300.

Heat removal or direct cooling may be performed by conduction or convection the rotating anode may be suspended on ball bearings with silver powder lubrication providing cooling by conduction.

The rotating anode may be used in an X-ray tube which is generating X-rays for high performance computer tomography, CT, scanning and angiography systems or for any other high performance medical X-ray tube.

The X-ray tubes may have power ratings of up to 80 or 100 kW and more, for instance up to 200 kW.

It has to be noted that embodiments of the present invention are described with reference to different subject-matters. In particular, some embodiments are described with reference to method type claims, whereas other embodiments are described with reference to the device type claims.

However, a person skilled in the art will gather from the above and the foregoing description that, unless otherwise notified, in addition to any combination of features belonging to one type of the subject-matter also any combination between features relating to different subject-matters is considered to be disclosed with this application.

However, all features can be combined providing synergetic effects that are more than the simple summation of these features.

While the present invention has been illustrated and described in detail in the drawings and foregoing description, such illustration and description are to be considered illustrative or exemplary and not restrictive; the present invention is not limited to the disclosed embodiments. Other variations to the disclosed embodiments can be understood and effected by those skilled in the art and practicing the claimed invention, from a study of the drawings, the disclosure, and the appended claims.

In the claims, the word "comprising" does not exclude other elements or steps, and the indefinite article "a" or "an" does not exclude a plurality. Any reference signs in the claims should be construed not as limiting the scope.

The invention claimed is:

1. A rotating anode comprising:

an outer ring compound comprising a first carbon material with a first material property and carbon fibres substantially aligned to a contour of the outer ring compound, wherein the outer ring compound is configured to mechanically stabilize the rotating anode;

an intermediate ring compound comprising a second carbon material with a second material property differing from the first material property;

an inner disc compound comprising a layered fibre structure and a third carbon material with a third material property differing from the first and the second material property, wherein the inner disc compound and the intermediate ring compound are configured to provide a thermally conductive interface between the intermediate ring compound and the inner disc compound; and an interface compound comprising a metallic or a semi-metallic material, wherein the interface compound is coupled to the intermediate ring compound and the inner disc compound.

2. The rotating anode according to claim 1, wherein the intermediate ring compound comprises as the second carbon material graphitic carbon.

3. The rotating anode according to claim 1, wherein the interface compound comprises as the metallic or semi-metallic material from the group comprising Titanium, Vanadium, Chromium, Manganese, Iron, Cobalt, Nickel, Copper, Zinc, Aluminium, Silicon, Zirconium, Niobium, Molybdenum, Palladium, Silver, Indium, Tin, Platinum or Gold.

4. The rotating anode according to claim 1, wherein the interface compound comprises as the metallic or semi-metallic material a mixture or an alloy from the group comprising Titanium, Vanadium, Chromium, Manganese, Iron, Cobalt, Nickel, Copper, Zinc, Aluminium, Silicon, Zirconium, Niobium, Molybdenum, Palladium, Silver, Indium, Tin, Platinum or Gold.

5. The rotating anode according to claim 3, wherein the interface compound comprises a melting or liquidus temperature above 1000° C.

6. The rotating anode according to claim 1, wherein the inner disc compound and the intermediate ring compound are configured to transport heat from the intermediate ring compound via the inner disc compound to an inner contour of the inner disc compound.

7. The rotating anode according to claim 6, wherein the outer ring compound is configured to limit thermal expansions of the rotating anode or to limit centrifugal forces or to limit other mechanical forces.

8. The rotating anode according to claim 7, wherein the intermediate ring compound comprises a metallic coating on a lateral side of the intermediate ring compound.

9. The rotating anode according to claim 7, wherein the intermediate ring compound is configured to transport heat from the intermediate ring compound to a surface of the rotating anode.

10. The rotating anode according to claim 1, wherein the inner disc compound comprises as the layered fibre structure a textile layer structure with a first preferred direction of fibre orientation and a second preferred direction of fibre orientation.

11. The rotating anode according to claim 10, wherein a first type of fibres is aligned along the first preferred direction and a second type of fibres is aligned along the second preferred direction.

12. The rotating anode according to claim 11, wherein the fibres of the first type are configured to mechanically stabilize the inner disc compound and the fibres of the second type are configured to provide thermal conductivity.

13. The rotating anode according to claim 1, wherein the outer ring compound is configured to limit a thermal expansion of the inner disc compound and the intermediate ring compound.

14. X-ray tube comprising a high voltage generator, a cathode, and a rotating anode according to claim 1.

15. Method for producing a rotating anode, the method comprising the steps of:

Providing an outer ring compound comprising a first carbon material with a first material property and carbon fibres substantially aligned to a contour of the outer ring compound, wherein the outer ring compound is configured to mechanically stabilize the rotating anode;

Providing an intermediate ring compound comprising a second carbon material with a second material property differing from the first material property and providing an inner disc compound comprising a layered fibre structure and a third carbon material with a third material property differing from the first and the second material property, wherein the inner disc compound and the intermediate ring compound are configured to provide a thermally conductive interface between the intermediate ring compound and the inner disc compound; and Providing an interface compound comprising a metallic or a semi-metallic material, wherein the interface compound is coupled to the intermediate ring compound and the inner disc compound.

* * * * *